United States Patent [19]

Maio et al.

[11] 4,433,778

[45] Feb. 28, 1984

[54] AUTOMATIC TILT DISPLAY CARTON

[75] Inventors: Patrick S. Maio, Ringwood; John F. Lee, Vernon, both of N.J.

[73] Assignee: Federal Paper Board Co., Inc., Montvale, N.J.

[21] Appl. No.: 419,163

[22] Filed: Sep. 17, 1982

[51] Int. Cl.[3] ..... B65D 5/20

[52] U.S. Cl. ..... 206/45.25; 229/16 D; 206/45.21

[58] Field of Search ..... 206/45.2, 45.21, 45.24, 206/45.14, 45.18, 45.23, 45.25, 44 R; 229/16 D, 41 B, 37 R

[56] References Cited

U.S. PATENT DOCUMENTS

| | | | |
|---|---|---|---|
| 1,416,465 | 5/1922 | Harvey | 206/45.21 |
| 1,667,376 | 4/1928 | Fehrenkamp | 206/45.25 |
| 1,732,226 | 10/1929 | Darragh | 206/45.24 |
| 2,052,675 | 9/1936 | Tanner | 206/45.18 |
| 2,139,534 | 12/1938 | Williamson | 206/44 R |
| 2,199,204 | 4/1940 | Lenkoff | 206/44 R |
| 2,294,641 | 9/1942 | Walters | 206/44 R |
| 2,294,965 | 9/1942 | Davidson | 229/16 D |
| 2,312,595 | 3/1943 | Smith | 229/16 D |
| 3,438,508 | 4/1969 | Kuns et al. | 211/133 |
| 3,520,468 | 7/1970 | Wiemann | 229/45 |
| 4,331,231 | 5/1982 | Boyle | 206/45.25 |
| 1,889,625 | 11/1932 | Barter | 206/44 R |
| 1,909,472 | 5/1933 | Keppler | 206/44 R |

*Primary Examiner*—William T. Dixson, Jr.
*Assistant Examiner*—Bryon Gehman
*Attorney, Agent, or Firm*—Charles A. Brown

[57] ABSTRACT

This relates to a display carton which is provided with an automatic tilt feature. An end wall of the carton extends down below the bottom wall so that when the carton is seated on a suitable support, the bottom wall slopes downwardly. There is provided a foldable interlock between the end wall and side walls and bottom wall of the carton whereby when the carton is erected, it will be locked in its erected open state with the end wall automatically positioned relative to the bottom wall to effect the tilting of the carton. The tilted carton permits the dispensing of a plurality of upstanding small articles from the carton with the articles leaning against the other end wall of the carton so as to maintain their upright positions when they are no longer supported by the large quantity of articles within the carton.

17 Claims, 5 Drawing Figures

AUTOMATIC TILT DISPLAY CARTON

This invention relates in general to new and useful improvements in cartons, and more particularly to a display carton having formed as a part thereof an automatic tilt mechanism wherein the carton slopes downwardly rearwardly when erected and set on a counter or other support.

In accordance with this invention, there is provided a display carton having a front wall which depends below the bottom wall of the carton so as to elevate the front of the carton when it is seated on a suitable support. The front wall has connecting flaps which are secured to the side walls of the carton and the front wall is so connected with the bottom wall and the side walls wherein when the carton is erected, the front wall assumes its depending relation with respect to the bottom wall and is locked in place.

Another feature of this invention is the provision of a blank for an automatic tilt display carton wherein there is a desirable saving of the paperboard from which the blank is formed while at the same time providing for the automatic tilt operation.

Another feature of the invention is the provision on the connecting flaps of the front wall of quarter round projections which, during the erection of the carton, swing through notches in the front corner of the bottom wall and provide for an effective interlock between the front wall on the one hand and the bottom wall and side walls on the other hand.

Another feature of the invention is the provision of an automatic tilt display carton wherein the front wall is of a greater height than the side walls of the carton and wherein the front wall depends below the bottom wall, and wherein the front wall is connected to the bottom wall by a connecting panel which is folded into overlying relation with respect to the lower portion of the front wall and which serves to space the lower edge of the front wall below the bottom wall, and more particularly wherein the front wall is provided with connecting flaps securable to side walls of the carton and the connecting flaps include quarter round projections which form interlocks with the bottom wall, the connecting panel having notched ends into which the quarter round projections are seated when the carton is in its assembled, but flat state.

With the above, and other objects in view that will hereinafter appear, the nature of the invention will be more clearly understood by reference to the following detailed description, the appended claims and the several views illustrated in the accompanying drawings.

Figure 1:
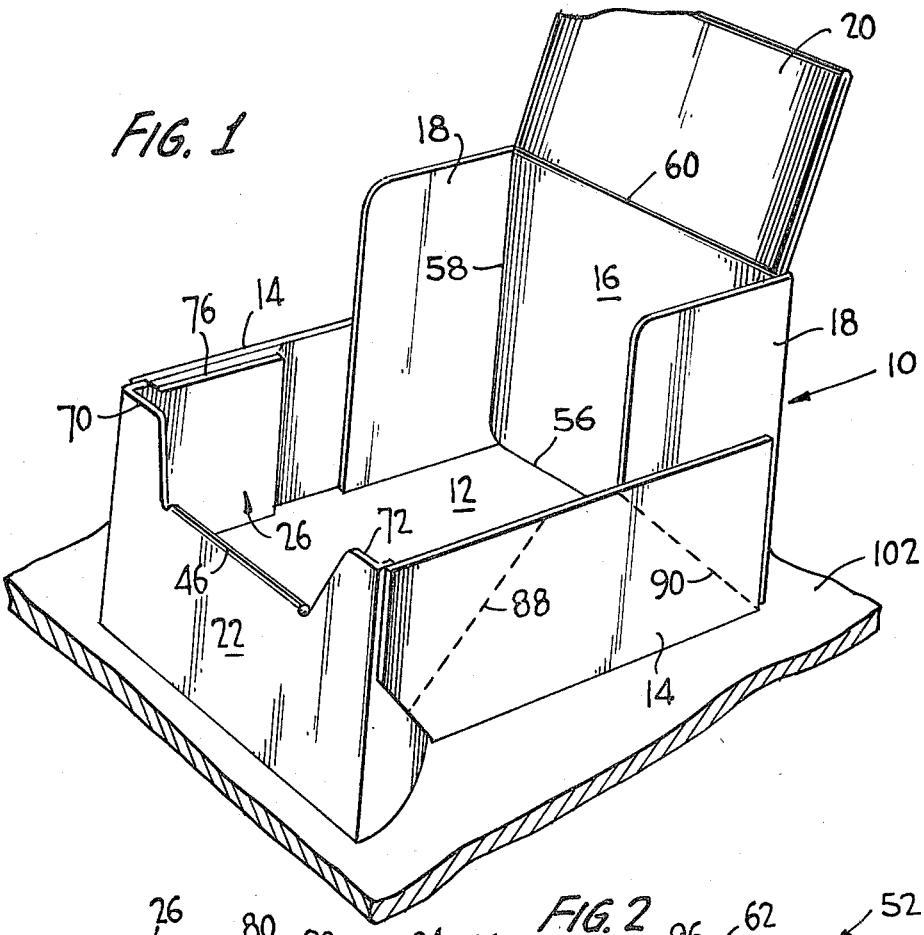
FIG. 1 is a front perspective view of the carton which is the subject of this invention, a major part of the top of the carton being omitted for purposes of clarity.

Referring now to the drawings in detail, it will be seen that there is illustrated in FIG. 1 a display carton having the automatic tilt feature which is the subject of this invention, the carton being generally identified by the numeral 10. The carton 10 includes a generally rectangular bottom wall 12 which has extending upwardly from opposite side edges thereof side walls 14. The carton 10 also includes a rear end wall 16 which has extending forwardly from the opposite vertical edges thereof connecting flaps 18. Lower portions of the connecting flaps 18 are disposed inwardly of the side walls 14 and fixedly secured thereto by suitable adhesive or gluing as will be described in more detail hereinafter.

The rear wall 16 has hinged connected to the upper edge thereof a top or closure panel 20 which is part of a top or closure which in itself forms no part of this invention and which is not shown in detail.

The carton 10 also includes a front end wall 22. The front wall 22 is of a greater height than the side walls 14 and has hingedly connected to its lower edge and folded vertically into face to face engagement with its inner or rear surface a connecting panel 24 (FIG. 3) which, in turn, has its upper edge hingedly connected to the forward edge of the bottom wall 12.

The front wall 22 has hingedly connected to its vertical side edges rearwardly extending connecting flaps 26 which are disposed inwardly of the side walls 14 and adhesively secured thereto.

Figure 3:
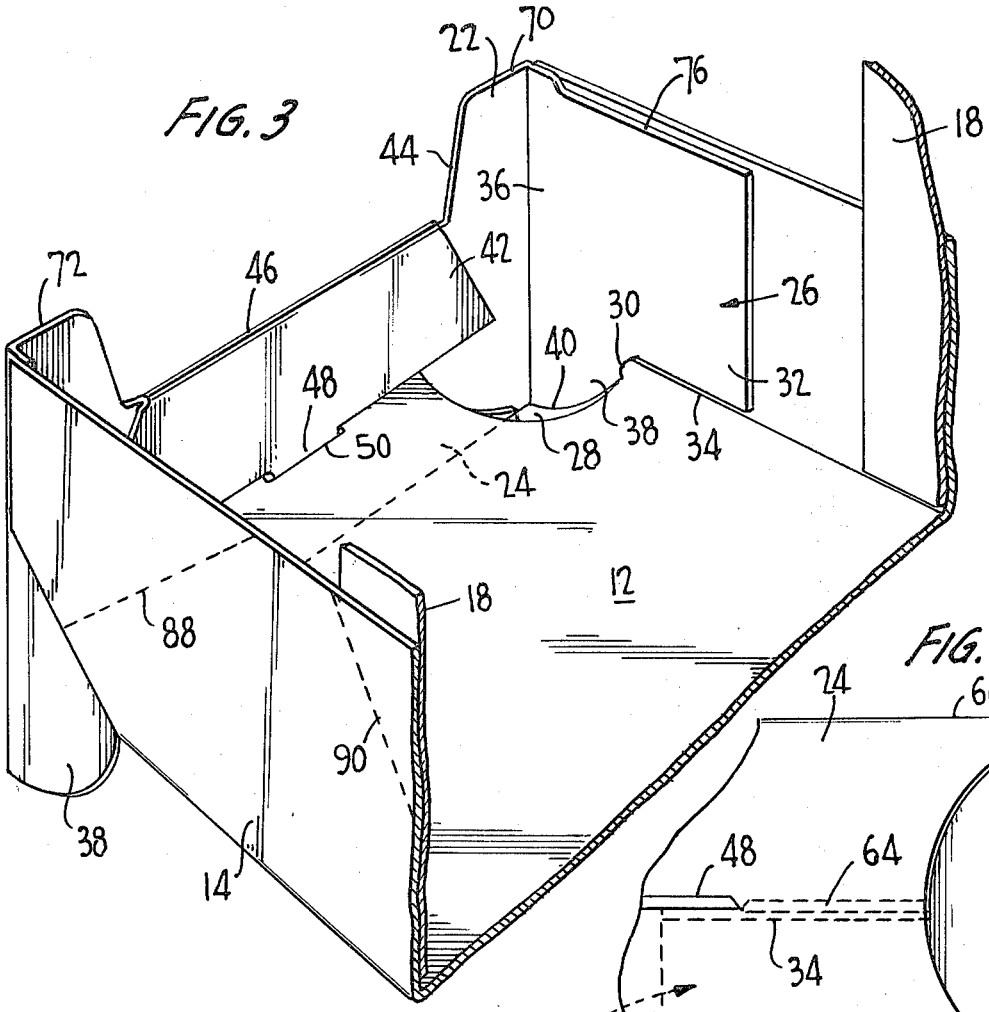
FIG. 3 is an enlarged fragmentary internal perspective view of the carton showing the details of the connections between the front wall and the side and bottom walls.

With reference to FIG. 3, it will be seen that each front corner of the bottom wall 12 is notched by way of a quarter round cutout 28 with the cutout being configurated to define a small projecting locking detent 30. It will also be seen that each connecting flap 26 has a rear portion 32 of a reduced height so as to have a lower edge 34 which closely overlies the bottom wall 12. Each connecting flap 26 also has a full height front portion 36 which includes a lower part in the form of a downwardly projecting quarter round projection 38. It is to be understood that the quarter round projection 38 has a rounded edge 40 which is part circular and of a radius corresponding to the radius of the cutout 28.

It will be seen that in the erected state of the carton 10, each quarter round projection 38 projects downwardly through the cutout 28 and is locked behind the detent 30 to maintain the carton in its erected state.

At this time it is also pointed out that an upper central portion 42 of the front wall 22 is cutout to define a notch 44 and is hingedly connected to the remainder of the front wall 22 along a hinge line 46. The position of the hinge line 46 and the height of the flap 42 is such that the flap 42 directly overlies the bottom wall 12 in the erected state of the carton. The flap 42 is provided with a projecting ear 48 which passes through a notch 50 formed along the hinge line between the connecting panel 24 and the front edge of the bottom wall 12 so as to stiffen the front portion of the carton.

Figure 2:
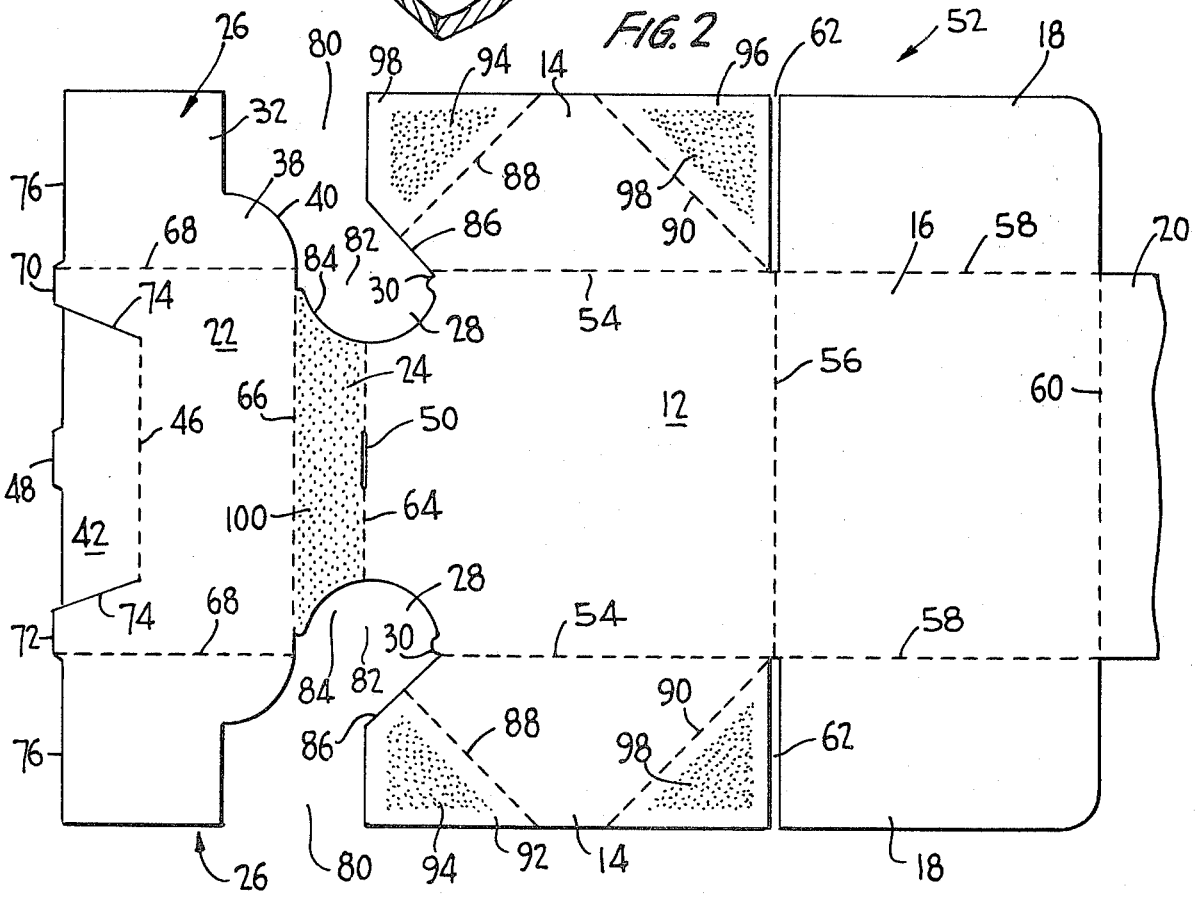
FIG. 2 is a plan view of the blank from which the carton is formed, that part of the blank which forms the top wall of the carton being omitted.

Referring now to FIG. 2 in particular, it will be seen that there is illustrated a blank, generally identified by the numeral 52, from which the carton 10 is formed. The blank 52 is formed of a suitable paperboard, and is generally rectangular in outline. The bottom wall 12 lies generally centrally of the blank 52 and has hingedly connected thereto along longitudinal fold line 54 the side walls 14.

The rear wall 16 is positioned longitudinally adjacent the rear edge of the front wall 12 and is hingedly connected thereto along a tranverse hinge line 56. The connecting flaps 18 are disposed on opposite sides of the rear wall 16 and each connecting flap is hingedly connected to the adjacent side of the rear wall 16 along a longitudinal hinge or fold line 58.

The top or closure panel 20 is positioned longitudinally adjacent the rear wall 16 and is connected thereto along a transverse hinge or fold line 60.

It is to be noted that the connecting flaps 18 are separated from the adjacent side walls 14 by a narrow cutout 62 which extends tranversely in alignment with the fold line 56.

The connecting panel 24 is positioned at the forward edge of the bottom wall 12 and is connected thereto along a tranverse hinge or fold line 64 which is aligned with the forward edges of the connecting flaps 14. The cutout 50 is positioned midway of the fold line 64.

The front wall 22 is hingedly connected to the connecting panel 24 along another transverse fold or hinge line 66. The connecting flaps 26 are disposed on opposite sides of the front panel 22 and are hingedly connected to the front panel 22 along longitudinally extending hinge or fold lines 68 which are aligned with the hinge or fold lines 54, 58.

The front wall 22 has a free transversely extending edge remote from the bottom wall 12 which is configurated to define three short projections 70, 72 and the aforedescribed projection or tab 48.

The front wall 22 is provided with a pair of cut lines 74 which are disposed transversely adjacent the projections 70, 72 and which converge towards the bottom wall 12. The inner ends of the cut lines 74 are connected by the previously described hinge or fold line 46 which extends transversely of the blank 52.

It will be seen that each connecting flap 26 has a transversely extending free edge 76 which is slightly longitudinally recessed relative to the projections 70, 72.

It will be further apparent from FIG. 2 that the blank has on each side thereof a large cutout 80 which extends between adjacent edges of the connecting flaps 26 and the side walls 14. Further, each cutout 80 has a generally semicircular inner portion 82 of which one half forms the cutout 28 in the respective front corner of the bottom wall 12 and a similar generally quarter round notch 84 in the respective end of the connecting panel 24.

It will also be seen that the corner of each connecting flap 14 disposed adjacent the bottom wall 12 and the front wall 22 is cut away so as to define a sloping edge portion 86. This cutting away of the corner of each side wall 14 is part of the respective cutout 80.

Each of the side walls 14 is provided with a pair of diagonal hinge or fold lines 88, 90 which diverge towards the corners of the side walls 14 which are disposed adjacent the fold or hinge lines 54 with the hinge or fold line 88 intersecting the diagonal edge 86.

Each diagonal fold line 88 defines a triangular corner portion 92 along the front part of the respective side wall 14 and this corner part is provided with an adhesive layer 94. In a like manner, each diagonal hinge or fold line 90 defines a rear triangular corner portion 96 of the respective side wall 14 and this carries adhesive 98. Finally, the connecting panel 24 is provided with an adhesive layer 100.

Figure 5:
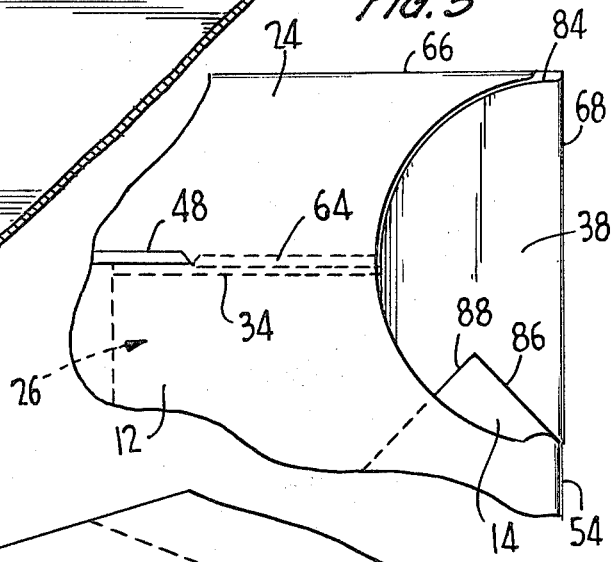
FIG. 5 is an enlarged fragmentary view of the underside of the folded carton showing the manner in which the quarter round portion of one of the connecting flaps seats in a like notch formed in the connecting panel.
Figure 4:
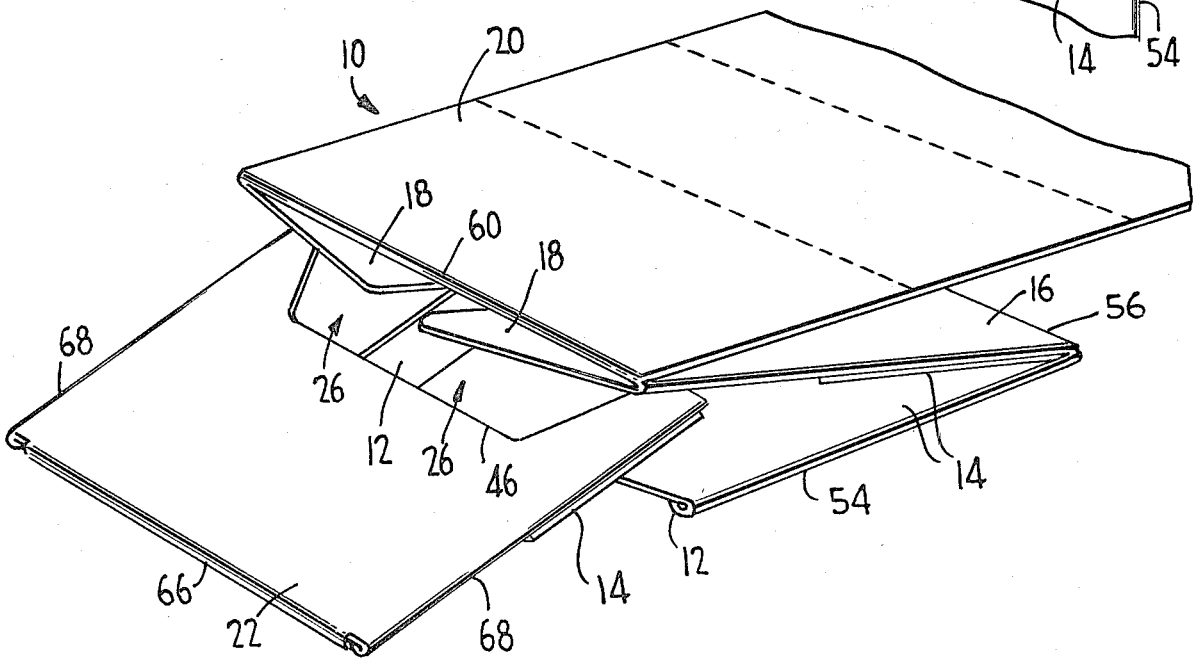
FIG. 4 is a fragmentary perspective view of the carton with parts of the top closure omitted and the carton in its assembled, but folded state.

In the assembly of the carton 10, the blank is reversely folded along the hinge or fold line 66 so that the connecting panel 24 will be in bonded face-to-face relation with the lower part of the front wall 22. The connecting flaps 18 and 26 are also adhesively secured to the side walls 14. When the connecting panel 24 and the connecting flaps 18 and 26 are so adhesively bonded to their respective walls, the assembled carton may be folded flat or substantially planar as is generally shown in FIG. 4. At this time each quarter round projection 38 lies against a portion of the front wall 22 immediately adjacent the respective end of the connecting panel 24 and is seated in the notch 84 as is clearly shown in FIG. 5.

When the assembled, but folded, carton 10 is to be erected, the rear wall 16 and the front wall 22 are pulled apart at which time the connecting flaps 18 and 26 begin to move, together with the side walls 14, away from the bottom wall 12 while the quarter round projections 38 begin to swing upwardly through the cutouts 28 with the lower edge 34 of each connecting flap 26 swinging across the face of the bottom wall 26 until the rear portion 22 of the connecting flap 26 comes into face-to-face engagement with the adjacent side wall 14. At this time the edge of the quarter round projection 38 disposed adjacent the connecting flap edge 34 snaps past the detent 30 so as to lock the connecting flaps 26 in their positions of FIGS. 1 and 3.

While this is being accomplished, the front wall 22 is moving to an upstanding position relative to the bottom wall 12 as is the rear wall 16. Of course, the connecting flaps 18 are swinging relative to the side walls 14 in the same manner described above with respect to the connecting flaps 26.

If so desired, the flap 42 may be prefolded with the locking tab 48 thereof seated in the cutout 50.

Once again it is pointed out here that the manner in which the top or closure of the carton is formed and erected forms no part of this invention.

It will be readily apparent from FIG. 1 that since the bottom portion of the front wall 22 extends down below the bottom wall 12, the bottom wall 12 is automatically tilted rearwardly when the carton 10 is seated on a suitable support, such as the support 102. In this manner, relatively small articles may be presented in upstanding positions and as the articles are removed from the carton 10, the remaining articles will tilt back against the rear wall 16 and retain their upright positions whereby they may be readily dispensed.

It is to be understood that although the illustrated and described carton tilts rearwardly, the rear of the carton could be constructed to be like the front so that the carton will tilt forwardly.

Although only a preferred embodiment of the carton has been specifically illustrated and described herein, it is to be understood that minor variations may be made in the carton without departing from the spirit and scope of the invention as defined by the appended claims.

We claim:

1. An automatic tilt display carton comprising a bottom wall, side walls extending upwardly from side edges of said bottom wall, and a first end wall connected to a first edge of said bottom wall, said end wall extending below said bottom wall and including a connecting panel directly depending from said bottom wall first edge, said first end wall having connecting flaps extending from opposite edges of said first end wall and secured to adjacent portions of said side walls wherein in the erected state of said carton said first edge of said bottom wall is elevated and said bottom wall tilts towards a second edge of said bottom wall, and a second end wall connected to said second edge of said bottom wall.

2. An automatic tilt display carton according to claim 1 wherein each connecting flap includes a portion overlying said bottom wall and having a lower edge disposed immediately adjacent said bottom wall.

3. An automatic tilt display carton according to claim 2 with each of said connecting flaps having a depending lower part extending below said bottom wall and said connecting flap portion lower edge with said connecting flap lower part and portion combining to form locking means engageable with said bottom wall to lock said carton in its open state, each side wall has formed therein in overlapping relation to its connecting flap a diagonal fold line extending downwardly to facilitate folding of said bottom wall, said side walls, said first end wall and said connecting flaps to a generally planar state.

4. An automatic tilt display carton according to claim 3 wherein said connecting panel opposes a lower part of said first end wall and has notched ends of a concaved shape for receiving said connecting flaps lower parts in said carton folded state.

5. An automatic tilt display carton according to claim 1 wherein each connecting flap includes a portion overlying said bottom wall and having a lower edge disposed immediately adjacent said bottom wall, said bottom having first corner portions each with a cut out, each of said side walls having an upwardly sloping bottom first edge, and each of said connecting flaps having a depending lower part extending below said bottom wall and said connecting flap portion lower edge with said connecting flap lower part and portion combining to form locking means engageable with said bottom wall to lock said carton in its open state.

6. An automatic tilt display carton according to claim 5 wherein said cut out and said connecting flap lower part are of similar sizes.

7. An automatic tilt display carton according to claim 5 wherein said connecting panel opposes a lower part of said first end wall and has notched ends of a concaved shape for receiving said connecting flaps lower parts in said carton folded state.

8. An automatic tilt display carton according to claim 7 wherein said first end wall has a reversely folded top central portion interlocked with said connecting panel.

9. An automatic tilt display carton according to claim 5 wherein said cut outs and said connecting flap depending lower parts are quarter round in outline.

10. A blank for forming an automatic tilt display carton, said blank comprising a bottom wall, side walls hingedly connected to side edges of said bottom wall and extending outwardly therefrom, a first end wall hingedly connected to a first edge of said bottom of said projections, and said connecting panel having notches at opposite ends thereof for receiving said projections in a partially erected state of said blank.

11. A blank according to claim 10 wherein, said connecting panel is of a width corresponding to a dimension wall and connecting flaps hingedly connected to side edges of said first end wall and extending outwardly therefrom, each of said connecting flaps having an outer portion of reduced height with that portion of each connecting flap adjacent said first end wall including a projection, wherein said first end wall includes a connecting panel between the remainder of said first end wall and said bottom wall.

12. A blank according to claim 11 wherein said projections and notches are substantially of the same size.

13. A blank according to claim 11 wherein said bottom wall has notched corners adjacent said connecting panel, said notched corners being of a configuration similar to that of said projection.

14. A blank according to claim 13 wherein said projections and notches are substantially of the same size.

15. A blank according to claim 11 wherein said projections and notches are of a quarter round outline.

16. A blank according to claim 10 wherein said bottom wall has notched corners adjacent said connecting panel, said notched corners being of a configuration similar to that of said projection.

17. A blank according to claim 16 wherein said projections and notches are substantially of the same size.

* * * * *